US006615417B1

(12) United States Patent
Newhard

(10) Patent No.: US 6,615,417 B1
(45) **Date of Patent: *Sep. 9, 2003**

(54) ANTI-ENTRAPMENT SWIMMING POOL AND WADING POOL MAIN DRAIN COVER AND METHOD

(75) Inventor: Harry W. Newhard, St. Louis, MO (US)

(73) Assignee: World Wide Sports, LLC, St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/003,643

(22) Filed: Nov. 2, 2001

Related U.S. Application Data

(63) Continuation-in-part of application No. 09/662,266, filed on Sep. 14, 2000, now abandoned.
(60) Provisional application No. 60/154,493, filed on Sep. 17, 1999.

(51) Int. Cl.[7] ..... E04H 4/00
(52) U.S. Cl. ..... 4/507; 4/504; 4/509; 4/498; 4/292
(58) Field of Search ..... 4/504, 507, 509, 4/498, 292

(56) References Cited

U.S. PATENT DOCUMENTS

| | | | |
|---|---|---|---|
| 780,341 | A | 1/1905 | Horner |
| 3,321,080 | A | 5/1967 | Pasini et al. |
| 3,378,858 | A | 4/1968 | Jacuzzi |
| 3,667,611 | A | 6/1972 | Pansini |
| D233,434 | S | 10/1974 | Ehmke |
| 3,940,807 | A | 3/1976 | Baker et al. |
| 4,115,878 | A | 9/1978 | Johnson et al. |
| 4,170,047 | A | 10/1979 | Corsette et al. |
| D254,928 | S | 5/1980 | Mathis |
| D261,419 | S | 10/1981 | Moreland |
| 4,359,190 | A | 11/1982 | Pagano |
| D275,315 | S | 8/1984 | Sarnoff et al. |
| D278,459 | S | 4/1985 | Cook |
| D286,319 | S | 10/1986 | Mathis |
| 4,658,449 | A | 4/1987 | Martin |
| D319,295 | S | 8/1991 | Ohaus |
| D333,342 | S | 2/1993 | Newhard |
| 5,376,264 | A | 12/1994 | Betancourt |
| 5,734,999 | A | 4/1998 | Nicholas |

*Primary Examiner*—Gregory Huson
*Assistant Examiner*—Azadeh Kokabi
(74) *Attorney, Agent, or Firm*—Peter S. Gilster; Linda L. Lewis; Greensfelder, Hemker & Gale, P.C.

(57) ABSTRACT

An anti-entrapment, anti-vortex swimming pool and/or wading pool drain cover having a discus or wheel-like configuration with a relatively large radius, substantially larger than the radius of a pool drain which the drain cover is intended to cover, so that the disk extends out over the pool floor or other surface having the drain, radially beyond the drain, the disk carrying beneath it a plurality of evenly spaced radial ribs which define between them channels opening at the periphery; the ribs support the cover on the surface in which the drain is located so that the disk periphery stands off that surface for water flow intake beneath through the side inlets; the ribs and channels control water flow beneath the disk so that water flows relatively evenly in the channels from the periphery and then into the drain without potential for pool user entrapment and substantially without vortex creation.

21 Claims, 3 Drawing Sheets

ANTI-ENTRAPMENT SWIMMING POOL AND WADING POOL MAIN DRAIN COVER AND METHOD

CROSS-REFERENCE TO RELATED APPLICATION

This continuation in part application claims the priority of U.S. provisional patent application Serial No. 60/154,493, filed Sep. 17, 1999, and utility patent application Ser. No. 09/662,266, filed Sep. 14, 200, now ABN. both entitled "Anti-Entrapment Swimming Pool and Wading Pool Main Drain Cover and Method," of the present inventor which application, continued preservation of which is requested.

BACKGROUND OF THE INVENTION

The invention relates to swimming pool and wading pool drains and, more particularly, to a drain cover which is of universal character useful for providing anti-entrapment, anti-vortex protection in a wide variety of swimming pools and wading pools.

Water circulation systems used in swimming pools and wading pools necessarily circulate and filter relatively large volumes of water, with water at many gallons per minute being pumped into these pools and simultaneously being drawn from these pools through one or more drain sumps and/or pool suction (all referred to herein for convenience simply as "drains") which may be located in the pool floor or a pool side wall. Conventional drain covers used in swimming pools and wading pools have been found to create a danger and potential hazard for pool users, and in particular, children, because the high volume of water flowing into drains beneath conventional drain tend to create a vortex (with its characteristic cyclonic flow) and/or such concentrated areas of flow that a child, for example, can literally be unable to remove a hand, foot or other body member from the drain cover with which the child has come into contact. Thus, there have been tragic drownings and other serious injuries, including the most hideous injury of disembowelment, of children in swimming pools and wading pools. These risks are not limited to children, but extend also to all persons who use pools having drains.

There have accordingly been demands in many regions and localities and jurisdictions throughout the United States of America and elsewhere in the world for protection against entrapment and injury at drains of swimming pools and wading pools. This has resulted, for example, in proposals, regulations or laws to require multiple drains in swimming pools and wading pools. Multiple drains are, however, not a good solution to the problems and resultant dangers of existing drains in swimming pools and wading pools, because it overlooks the fact that water pressure, dependent upon pool depth, exerts a force proportional to the cross-sectional area of a drain. The mere provision of one or more additional main drains of comparable area does not reduce the force of water pressure across the area of a drain, and does not solve a problem of entrapment resulting from suction developed in the pool circulation system which draws water in through the drain, from which pool users must be protected from entrapment.

What is required, as provided by the new drain, is altering of the way in which water enters the drain by providing for the drain widely dispersed water entrance passages, each of small cross-sectional area, and each preferably designed so as to be inherently non-entrapping, and from which water entering the drain is channeled. It is also desired to avoid of the usual vortex which may develop as water enters an unprotected drain. But it is also required that a protective drain cover must be extremely strong, with capability to support nearly 400 pounds of weight without cracking or damage.

Newhard U.S. Des. Pat. No. Des. 333,342 was issued to the present inventor in 1993 Anti-Vortex Safety Cover For A Drain, and included ornamental features useful in drain covers for anti-vortex but was configured so that it could extend into a drain opening, i.e., sump, of a swimming pool and including ribs, which were tapered, angled, and, therefore, not of constant height. Additionally, the ribs of the present invention are of sufficient height that at a predetermined drain cover diameter, the flow rate of water into the inlet is about 1.5 cubic feet per second. Typically, the height is in the range of about 0.25 to 0.75 inches. Further, the drain cover shown in that patent did not disclose various information such as relative dimensions and relationships or flow characteristics, nor did it disclose specific securement to a drain.

SUMMARY OF THE INVENTION

Accordingly, among the several objects, features and advantages of the invention may be noted the provision of drain cover for swimming pool and/or wading pool drains (suction fittings) which is anti-entrapment, anti-vortex, and injury-preventing and method of drain protection for users of such pools; and which thus is a safety device and method; which avoids any danger or potential hazard for pool users, and in particular, children, even when a high volume of water flows into a drain with which the new device is used; which is inherently non-entrapping, as well as avoiding development of the usual vortex which may develop as water enters the drain which it covers protectively; which alters of the way in which water enters the drain it protects by providing widely dispersed water entrance passages, each of small cross-sectional area, and each preferably designed so as themselves to be inherently non-entrapping; which accordingly does not have any dangerous concentrated areas of flow that might entrap the hand, foot, hair, other body member or clothing of a child even when a child comes into contact with the new device; which can prevent drain-related drownings and other serious injuries; and which protects not only children but all persons of small size, low weight, and relatively low strength; which is easy to install in connection with a wide range of sizes of conventional drains and yet does not extend into a drain opening; which does not require modification of existing drains; which does not require installation of additional drains; which is extremely easily and rapidly installed in place of existing drain covers; which is simple, reliable, inexpensive and highly durable in construction; and which is aesthetically pleasing.

Briefly, the drain cover is of wheel-like configuration, formed by a disk, i.e., a round flat plate, having a relatively large radius, substantially larger than the radius of any pool sump or suction inlet ("drain") which the drain cover is intended to cover, so that the disk extends out over the pool floor or other surface having the drain radially beyond the drain, the disk carrying beneath it a plurality of evenly spaced radial ribs which define between them channels opening at the periphery, such that there is a side inlet between each pair of ribs. The ribs support the cover on the surface in which the drain is located so that the disk periphery stands off that surface for water flow intake beneath through the side inlets. The disk periphery is provided with multiple arcuate recesses, at least one such recess being between each rib pair, so that each arcuate recess also opens into the channel between each rib pair. The ribs and channels control water flow beneath the disk so that water flows relatively evenly in the channels from the periphery and then into the drain without potential for pool user entrapment and substantially without vortex creation. The arcuate recesses further preclude entrapment by allowing flow to enter the channels beneath the disk even when any of the sides is blocked by the body of a pool user or other object. The disk has screw-receiving openings, preferably in the forms of screw-receiving slots, for accommodating attachment to various sizes of drains.

The drain cover is accordingly of universal character useful for providing anti-entrapment, anti-vortex protection in the widest possible variety of swimming pools and wading pools. A method of protecting users of a swimming pool or wading pool from entrapment in a drain of such a pool by the use of such a drain cover, so configured, is disclosed accordingly.

Other objects and features will be apparent or are pointed out more particular hereinbelow.

BRIEF DESCRIPTION OF THE DRAWINGS

Corresponding characters indicate corresponding elements in different views of the drawings.

DESCRIPTION OF PRACTICAL EMBODIMENT

Figure 4:
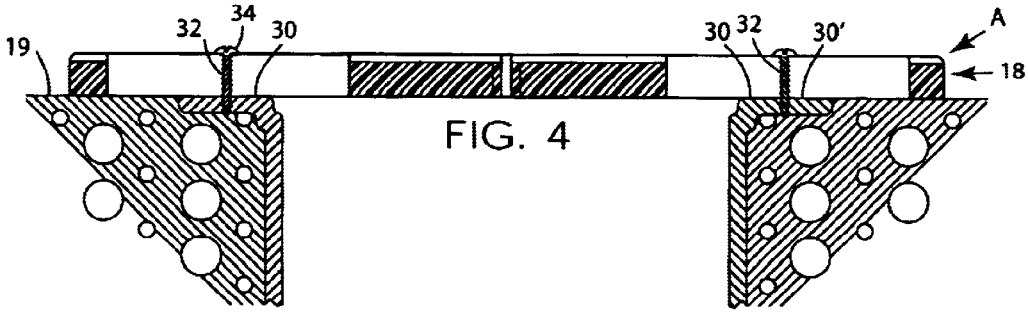
FIG. 4 is a cross-section taken along line 4—4 of FIG. 3.
Figure 5:
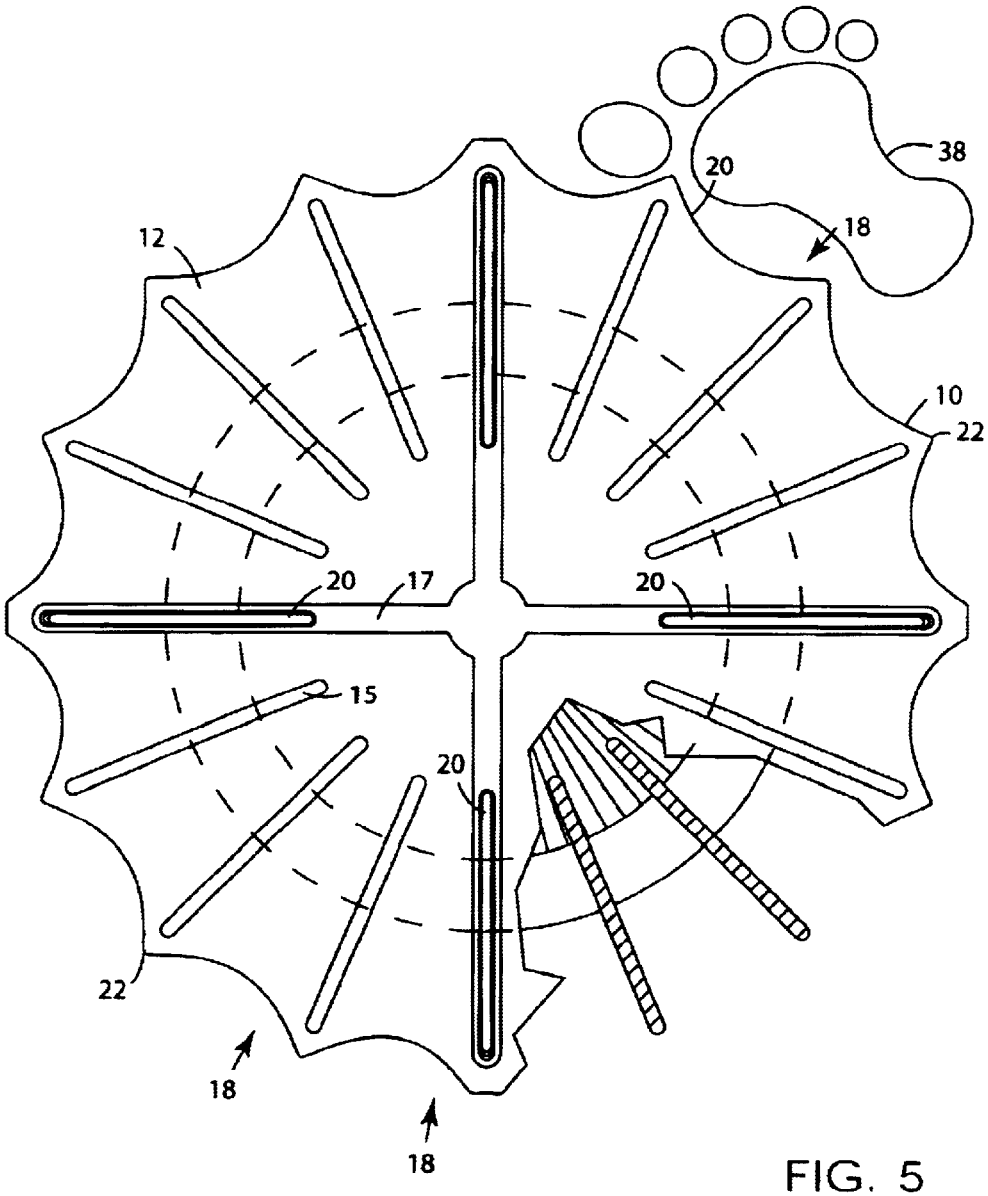
FIG. 5 is a top view of the new drain cover, partly cut away, illustrating method of operation and function of the drain cover and its water flow characteristics in use.

Referring to the drawings, illustrated generally at A is an embodiment of an anti-entrapment, anti-vortex swimming pool and/or wading pool drain cover, for protectively covering the drain in the floor or wall of a swimming pool and/or wading pool, as shown in FIG. 4. As noted herein above, the terms "sump" or "suction fitting" "suction inlet" or "water inlet fitting" or "circulation system inlet" all are synonymous with the term "drain."

Figure 1:
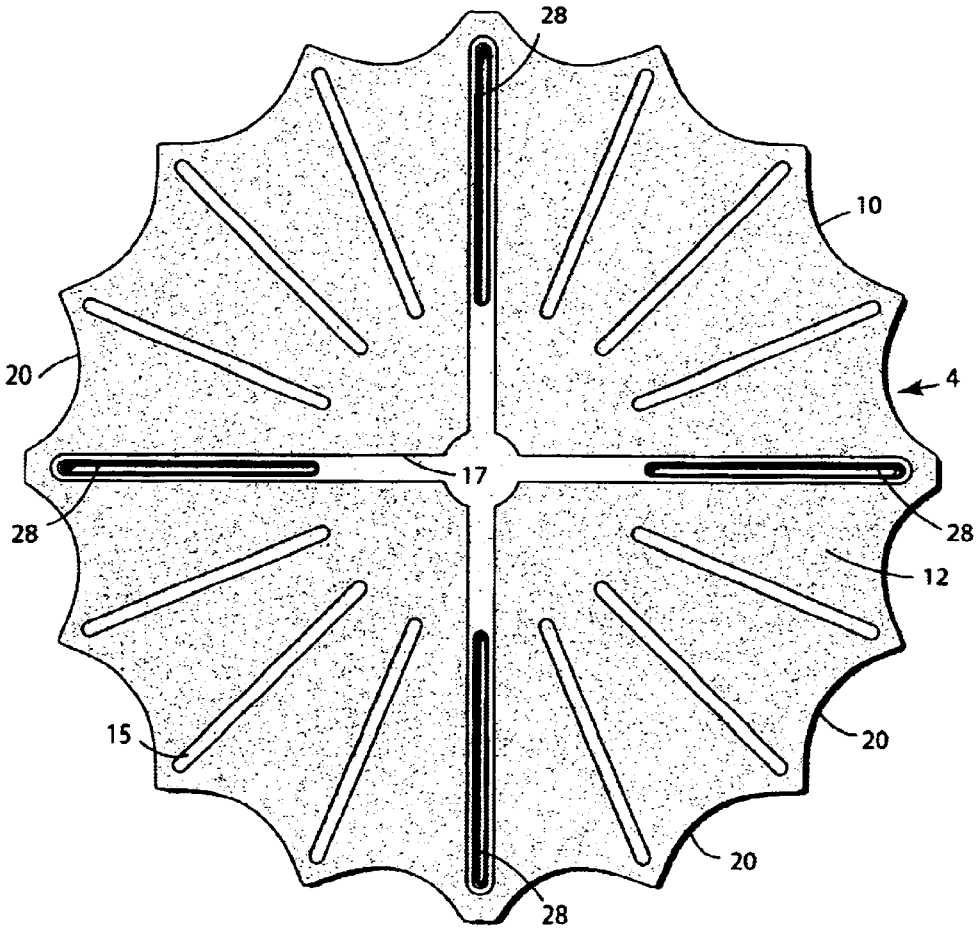
FIG. 1 is a top plan view of a drain cover in accordance with and embodying the present invention.
Figure 2:
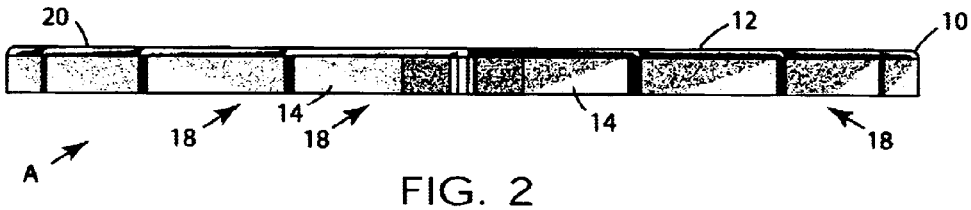
FIG. 2 is a side elevation view thereof.

Referring to FIGS. 1 and 2, the drain cover A is an integral unit, molded for example of polypropylene or other strong, durable, crack-resistant thermal plastic or polymer, copolymer, terpolymer, etc., such as for example, ABS, nylon and other suitable synthetic resin materials. Polypropylene is preferred because of its strength and adaptability to molding but also because of its resistance to chemicals in the water of such pools and to ultraviolet (UV) radiation.

Drain cover is generally of discus or wheel-like configuration, being formed by a disk 10 having a relatively large radius, as compared with the radius of any drain which it is intended to cover, so that the disk as installed extends radially beyond the drain in all directions out over the pool floor or other surface in which the drain is located. Disk 10 has a substantially flat surface 12, although it includes indentations as mold recesses discussed hereinbelow.

Figure 3:
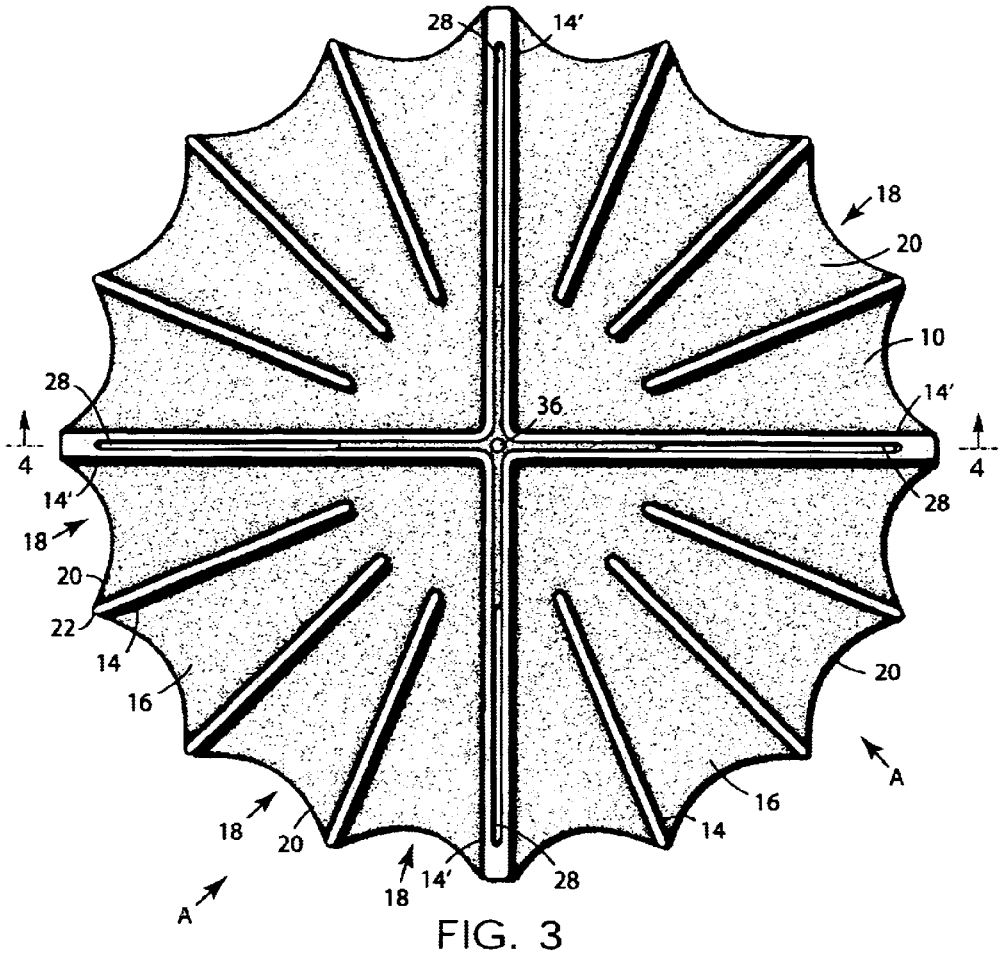
FIG. 3 is bottom plan view of the drain cover.

Referring now also to FIG. 3, which is a bottom plan view of disk cover A, disk 10 carries beneath it a, polarity of evenly spaced radial ribs 14 which extend from a point of near the center of disk 10 outwardly to the perimeter which is, as will be apparent from FIGS. 1 and 3, of essentially scalloped nature, as explained below. Each pair of ribs 14 defines between them a channel 16. As a total of sixteen ribs are provided, there are sixteen channels, each opening at the perimeter of the role of disk 10 to provide a corresponding side inlet, ("inlet" as herein defined is inlet to the drain) as generally designated by reference numeral 18 in FIGS. 2 and 3. There are, accordingly, sixteen such side inlets 18.

Referring to FIGS. 2 and 3, ribs 14, all of which are substantially constant height and extend fully to the peripheral of disk 10, intended to support the cover on a pool floor or other surface 19, as shown in FIG. 4, for water flow intake through side inlets 18 rather than through disk 10.

Safety standards have been set for the use of drains in swimming pools. It is desired the flow rate into the drain cover inlet 18 be equal to or less than about 1.5 cubic feet per second. To accomplish this, the present invention provides an area of the drain cover inlets 18 to be sufficiently large that for a flow rate of 80 gallons per minute, the flow rate of water entering the drain cover inlet 18 is about 1.5 cubic feet per second, or less. The dimensions of the drain cover are critical. The ribs need to be of sufficient height to allow flow and to create, along with the circumference of the cover, a large enough cross-sectional area of the inlet 18 to reduce the flow rate to about 1.5 cubic feet per second. Further, the ribs cannot be too high, or digits, hands or feet may become entrapped in the opening created beneath them. Therefore, the height of the ribs is in the range of from about 0.25 inch to about 0.75 inch. The preferred height is in the range of about 0.25 to about 0.5 inch. The most preferred height is about 0.5 inch.

Likewise, the diameter of the cover is critical, in that it must extend beyond the diameter of the sump, and it must be large enough to create, in combination with the height of the ribs, inlet 18 large enough to reduce the flow of the water to about 1.5 cubic feet per second. Since the sump diameter opening is typically in the range of about 5 to 6 inches, the drain cover diameter is in the range of about 8 to 14 inches. Preferably, the diameter is in the range of about 10 to 13 inches, and the preferred diameter is about 12 inches. For small diameter covers (e.g., less than 12 inches), the ribs must be higher, and vice versa, for large diameter covers (e.g., larger than 13 inches), the ribs may be lower and achieve the desired flow rates.

Optionally, the perimeter of the cover is provided with a continuous series of crescent-form arcuate recesses 20, and the area of the drain inlet 18 is further increased beyond that of a simple circle.

With reference to FIGS. 1 and 3, disk 10 is further provided around its perimeter with a continuous series of crescent-form arcuate recesses 20, there being one such recess 20 between each pair of ribs 14, and so that each arcuate recess 20 also opens into a corresponding channel 18 between each pair of ribs. Because of recesses 18, the disk periphery is effectively scalloped about its periphery, seemingly by crescent-form cutouts, which are simply are the continuous series of recesses or scallops each forming an angular projection, as at 22, between each pair of recesses 20. Projections 22 are thus cusps to which a respective rib 14 extends radially. A cusp is located between each arcuate recess 20 and defines the outer extremity of its corresponding rib 14.

The foregoing that channels 16 are arranged and equal quarters or sectors beneath disk 10. By reference to FIG. 3 it is seen that there four sectors, with four channels in each of the sectors. In FIG. 3, a sector is illustrated by a bracket designated 24. Correspondingly, four principal ribs 14 define or demarcate the sectors. The principal ribs are joined at 26 beneath the cover and are effectively doubled main ribs.

It will be apparent in FIG. 1 that shallow molding recesses 15 and 17 are provided in the surface 12 of disk 10 to provide a non-slip surface, should it be engaged by a pool user, and for purposes of facilitating high quality molding, as well providing industrial styling and aesthetics emphasizing function of cover A.

Referring to FIG. 1 also, the doubled main ribs 14 define between them elongated securement slots 28 for receiving attachment devices such as screws, drive pins, lock pins, keys, clips, camming fasteners, or other known fastening expedients, for interengaging cover A and a structure of the drain such as designated at 30 in FIG. 4. Any such devices can be used as means for securement of the drain cover but, 8 screws are typical.

As thus shown in FIG. 4, screws 32 are shown as examples of the manner in which attachment is made by threading of screws into a flange 30 of the drain. However, a variety of drain combinations are possible including those which have no flange at all, as may in fact be more common; but typically threaded screw-receiving bores are provided in a drain.

Screws 32 simply represent the many possible forms of screws or other attachment devices which may be used. Screws 32 have enlarged heads 34 which extend beyond the shoulders of securement slots 28 for reliably engaging the drain. A center bore 36 can also be present, as illustrating, for receiving a central screw if the drain to be protectively covered by cover A includes a central screw-receiving opening.

In operation as thus installed, new drain cover A very effectively allows water to be drawn into the drain through side inlets 18 in all the sectors, and with ribs 14 and channels 16 controlling water flow beneath disk 10 so that water flows relatively evenly in the channels from the periphery and then into the drain without potential for pool user entrapment and substantially without vortex creation. The crescent- or arcuate-form recesses, or scallops, 20 further preclude entrapment by allowing flow to enter the channels beneath the disk when any of the side inlets is blocked by the body of a pool user or other object adjacent the disk periphery. For example, a child's foot, as symbolically shown at 38, could come into contact with the scalloped periphery. Even if such a body member of a pool user (or any other object) comes into contact with the periphery, each scallop or arcuate recess 20 acts to permit continued flow into its corresponding channel 16, so that not even one channel 16 is blocked. If an arcuate recess 20 is blocked by a pool user or object, flow continues to be provided through the underlying side inlet 18, and vice versa.

A average diameter of disk 10 may be about one foot, and slightly more at the cusps 22, where the radius may be about 6.5 in. and with radius accordingly to midpoint of each recess of about 6.0 in. By comparison, drains have an inside diameter measured in a few inches, such as 5 in. to 7 in., as merely examples, but typically with radius of 2.5 in. to 3.5 in., being thus much less than the radius of disk 10 at any point along its periphery. In any event, a wide region peripherally about the drain is covered protectively by disk 10, so that intake area through side inlets 18 is widely distributed to areas and water intake area is effectively increased with corresponding reduction in flow rate through any inlet 18 or recess 20, such that nonturbulent water flow is provided so as to eliminate or substantially reduce any vortex. Flow accordingly into the periphery of disk 10 is smooth and will not entrap a pool user.

A conventional pool drain may be intended to permit intake flow of 60–80 gpm, but the new pool cover does not interfere with flow. In testing, the new drain cover exhibited a flow rate into a pool drain protected by it of 80 gpm, meaning that approximately 5.0 gpm flowed in each of channels 16. However, it will be understood that because of pool drain locations at various possible sites on pool floors and walls, and because of differences produced by varying depths and the close proximity of pool walls, for example, flow rates in each of the channels of a drain protected by the new drain cover necessarily will vary. Thus, it may not be possible to quantify flow rate in each of flow channels 16 for each of myriad possible installations, but each cover A can readily handle at least 80 gpm of water flow into the drain.

Securement slots 28 are themselves of relatively small cross-section which do not substantially contribute to water flow, as compared to water flowing beneath the disk from its periphery through either the side inlets or the crescent-form recesses. Although slots 20, being preferably open, permit small, insignificant amounts of water to flow into the drain, bypassing the peripheral inlets, the flow through the narrow slots 20 of small cross-suction is insignificant as compared with the inlet area at the periphery of disk 10. Although knock-outs for slots 20 are possible, they are quite likely not practical. Neither would it be practical to drill through the cover in lieu of slots, because the molding would be difficult. More significantly, the new drain covers might be installed in existing, already-filled, pools. As an underwater installation, the cover must be easy to install, and the attachment slots greatly facilitate rapid installation.

Accordingly, it is seen that drain cover A provides a novel and highly effective method of protecting users of a swimming pool or wading pool from entrapment in a drain of such a pool, comprising covering the drain with disk 10 having a radius substantially greater than the radius of the drain, so that the disk extends out radially beyond the drain in all directions over the pool floor surface or other surface in which the drain is located, providing beneath the disk a series of radial ribs 14 which define between them channels 16 opening at the periphery to provide side inlets 18, such that there is a side inlet between each pair of ribs, the ribs supporting the cover on said surface in which the drain is located, so that the disk periphery stands off said surface, for water flow intake beneath the disk through side inlets 18, providing around the periphery of the disk a plurality of recesses 20 each adjacent the next, such that at least one such recess also opens into the channel 16 between each pair of ribs 14, and using ribs 14 and channels 16 to cause water to flow relatively evenly in the channels through the side inlets and recesses from the periphery and then into the drain without potential for pool user entrapment and substantially without vortex creation. The method thus provided thus also comprises the feature of allowing flow to enter the channels beneath the disk when any of the side inlets is blocked by the body of a pool user or other object adjacent the disk periphery. The method further comprises securing the drain cover in concentric relation to the drain by using attachment devices extending through the disk for attachment to drain structure.

In view of the foregoing description of the present invention and practical embodiments it will be seen that the several objects of the invention are achieved and other advantages are attained. The embodiments and examples were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with claims of the application and their equivalents.

What is claimed is:

1. A drain cover for protectively covering a drain of a swimming pool or wading pool, the drain cover being of wheel-like configuration and comprising a disk of radius substantially greater than the radius of the drain, so that the disk extends out radially beyond the drain in all directions over the pool floor surface or other surface in which the drain is located, wherein the disk has a periphery and is substantially a round flat plate, the disk carrying beneath it a series of radial ribs which define between them channels opening at the periphery of the disk to provide water inlets at the periphery, such that there is a side inlet between each pair of ribs, the ribs supporting the cover on said surface in which the drain is located for water flow intake beneath the disk through the side inlets, so that the disk periphery stands off said surface, the ribs and channels controlling water flow beneath the disk so that water flows relatively evenly in the channels through the side inlets from the periphery and then into the drain without potential for pool user entrapment and substantially without vortex creation, and means for securement of the drain cover over the drain, wherein the ribs are substantially flat and do not extend into the drain, wherein the height of the ribs is substantially constant and in the range of from about 0.25 to about 0.75 inch, and the diameter of the disk is in the range of about 8 to about 14 inches, such that the drain cover achieves a drain flow rate of 80 gallons per minute but a flow rate of 1.5 cubic feet per second or less into each inlet of the drain cover.

2. A drain cover as set forth in claim 1, wherein the disk defines about its periphery a plurality of recesses which provide for flow of water into the channel between each pair of ribs, said recesses further precluding pool user entrapment by allowing flow to enter the channels beneath the disk by flow through the recess when any of the side inlets is blocked by the body of a pool user or other object adjacent the disk periphery.

3. A drain cover as set forth in claim 2 wherein said recesses are arcuate, and there is at least one said recess formed between each pair of ribs such that a recess opens upwardly through the disk between each pair of ribs peripherally of the disk, such that flow of water may occur downwardly either through the respective recesses or laterally through the side openings, or both.

4. A drain cover as set forth in claim 3 where said recesses are of crescent form, and the disk periphery is accordingly scalloped.

5. A drain cover as set forth in claim 4 wherein a cusp is formed between each pair of said recesses to which cusp a respective rib extends.

6. A drain cover as set forth in claim 1 wherein the means for securement of the drain cover is provided by at least a pair of securement openings which extend through the disk for receiving attachment devices extending through the openings for engaging structure of the drain.

7. A drain cover as set forth in claim 6 wherein the said at least one pair of securement openings are pairs of slots extending radially across at least a portion of the upper surface of the disk, the slots being by themselves of relatively small cross-section so that only a relatively small amount of water may flow through the securement openings, such that the slots do not substantially contribute to water flow into the drain, as compared to water flowing beneath the disk from its periphery.

8. A drain cover as set forth in claim 1 wherein said channels are arranged in substantially equal quarter sectors beneath the disk.

9. A drain cover as set forth in claim 1 wherein said channels are arranged in four substantially equal arcuate sectors beneath the disk.

10. A drain cover as set forth in claim 9 wherein said channels are arranged in four sectors beneath the disk, there being multiple channels in each of the sectors.

11. A drain cover as set forth in claim 10 wherein four of said channels are equally spaced circumferentially in each of said sectors.

12. A drain cover as set forth in claim 9 wherein four of said ribs are provided by an orthogonally intersecting pair of doubled main ribs which extend transversely between opposite edges of the disk, and are arranged in substantially equal quadrilateral sectors beneath the disk.

13. A drain cover as set forth in claim 12 wherein the doubled main ribs define between them securement slots opening at least in part through the disk for providing said means for securement, the securement slots receiving attachment devices for engaging structure of the drain.

14. A drain cover as set forth in claim 13 wherein the securement slots are of relatively small cross-section as compared with the side inlets so that only a relatively small amount of water may flow through the securement slots which accordingly do not substantially contribute to water flow into the drain, as compared to water flowing beneath the disk from its periphery.

15. For protective use with the drain of a swimming pool or wading pool, a drain cover for protectively covering the drain, the drain cover being of wheel-like configuration and comprising a disk of radius substantially greater than the radius of the drain such that the disk extends out radially beyond the drain in all directions over the pool floor surface or other surface in which the drain is located, wherein the disk has a periphery and is substantially a round flat plate, the disk carrying beneath it a series of radial ribs which define between them channels opening at the periphery to provide water inlets at the periphery, such that there is a side inlet between each pair of ribs, the ribs supporting the cover on said surface in which the drain is located, so that the disk periphery stands off said surface, for water flow intake beneath the disk through the side inlets, the ribs and channels controlling water flow beneath the disk so that water flows relatively evenly in the channels through the side inlets from the periphery and then into the drain without potential for pool user entrapment and substantially without vortex creation, and means for securement of the drain cover over the drain, wherein the ribs are substantially flat and do not extend into the drain, wherein the height of the ribs is substantially constant and in the range of from about 0.25 to about 0.75 inch, and the diameter of the disk is in the range of about 8 to about 14 inches such that the drain cover achieves a drain flow rate of 80 gallons per minute but a flow rate of 1.5 cubic feet per second or less into each inlet of the drain cover.

16. A drain cover as set forth in claim 15, wherein the disk defines about its periphery a plurality of recesses which provide for flow of water into the channel between each pair of ribs, said recesses further precluding pool user entrapment by allowing flow to enter the channels beneath the disk by flow through the recess when any of the side inlets is blocked by the body of a pool user or other object adjacent the disk periphery.

17. A drain cover as set forth in claim 15 wherein the means for securement of the drain cover is provided by at least a pair of securement openings in the form of slots extending radially from the center of the disk, which extend through the disk for receiving attachment devices extending through the openings for engaging structure of the drain, the securement openings comprising pairs of slots extending radially across at least a portion of the upper surface of the disk, the slots being by themselves of relatively small cross-section so that only a relatively small amount of water may flow through the securement openings, such that the slots do not substantially contribute to water flow into the drain, as compared to water flowing beneath the disk from its periphery.

18. A method of protecting users of a swimming pool or wading pool from entrapment in a drain of such a pool, comprising covering the drain with a disk having a radius substantially greater than the radius of the drain, so that the disk extends out radially beyond the drain in all directions over the pool floor surface or other surface in which the drain is located, wherein the disk has a periphery and is substantially a round flat plate, providing beneath the disk a series of radial ribs which define between them channels opening at the periphery to provide side inlets, such that there is a side inlet between each pair of ribs, the ribs supporting the cover on said surface in which the drain is located, so that the disk periphery stands off said surface, for water flow intake beneath the disk through the side inlets, providing around the periphery of the disk a plurality of recesses, each adjacent the next, such that at least one such recess also opens into the channel between each pair of ribs, and using the ribs and channels to cause water to flow relatively evenly in the channels through the side inlets and recesses from the periphery and then into the drain without potential for pool user entrapment and substantially without vortex creation, wherein the ribs are substantially flat and do not extend into the drain, wherein the height of the ribs is substantially constant and in the range of from about 0.25 to about 0.75 inch, and the diameter of the disk is in the range of about 8 to about 14 inches such as to achieve a drain flow rate of 80 gallons per minute but a flow rate of 1.5 cubic feet per second or less into each said side inlets.

19. A method as set forth in claim 18 further comprising allowing flow to enter the channels beneath the disk when any of the side inlets is blocked by the body of a pool user or other object adjacent the disk periphery.

20. A method as set forth in claim 18 further comprising securing the drain cover in concentric relation to the drain by using attachment devices extending through the disk for attachment to the drain.

21. A method as set forth in claim 18 comprising using the drain cover to handle flow into the drain of at least 80 gpm or more of water flow into the drain.

* * * * *

UNITED STATES PATENT AND TRADEMARK OFFICE

CERTIFICATE OF CORRECTION

PATENT NO. : 6,615,417 B1
APPLICATION NO. : 10/003643
DATED : September 9, 2003
INVENTOR(S) : Harry W. Newhard It is certified that error appears in the above-identified patent and that said Letters Patent is hereby corrected as shown below:

Column 1, Line 10, delete "Sep. 14, 200, now ABN" and insert --Sep. 14, 2000, now abandoned--.

Column 4, line 65, delete "14" and insert --14'--.

Column 5, line 7, delete "14" and insert --14'--.

Column 5, line 14, delete "8" in bold font and insert --8-- in regular font.

Signed and Sealed this

Seventeenth Day of July, 2007

JON W. DUDAS
*Director of the United States Patent and Trademark Office*